US006941620B1

(12) United States Patent
Hinds

(10) Patent No.: US 6,941,620 B1
(45) Date of Patent: Sep. 13, 2005

(54) STRAP INTERCONNECTION ADJUSTING ASSEMBLY

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 0 days.

(21) Appl. No.: 10/600,384

(22) Filed: Jun. 19, 2003

(51) Int. Cl.[7] ..... A44B 11/00
(52) U.S. Cl. ..... 24/134 R; 24/134 KA; 24/134 KB; 24/163 R; 24/308; 482/129
(58) Field of Search ..... 24/134 P, 132 WL, 24/134 N, 133, 306, 115 G, 122.6, 136 L, 24/191–193, 308, 163 R, 132 R, 134 R, 24/134 KA, 134 KB, 134 L, 132 AA; 482/111, 482/124, 129; 472/128

(56) References Cited

U.S. PATENT DOCUMENTS

| | | | | |
|---|---|---|---|---|
| 307,345 | A | 10/1884 | Smith | |
| 631,486 | A | 8/1899 | Fischer | |
| 1,139,036 | A | 5/1915 | Humphrey | |
| 2,442,266 | A | 5/1948 | Davis | |
| D171,045 | S | 12/1953 | Noe | |
| D188,897 | S | 9/1960 | Prete, Jr. | |
| 3,020,612 | A | 2/1962 | Meeker | |
| 3,165,805 | A | 1/1965 | Lower | |
| 3,678,542 | A | 7/1972 | Prete, Jr. | |
| 4,027,876 | A * | 6/1977 | Johnston | 482/120 |
| 4,090,706 | A * | 5/1978 | Reda | 482/122 |
| D274,861 | S | 7/1984 | Lindblad | |
| 4,477,947 | A * | 10/1984 | Lyons | 24/115 G |
| 4,544,155 | A * | 10/1985 | Wallenbrock et al. | 482/129 |
| 4,685,671 | A * | 8/1987 | Hagerman et al. | 482/124 |
| 5,193,252 | A * | 3/1993 | Svehaug | 24/115 G |
| 5,518,486 | A * | 5/1996 | Sheeler | 482/131 |
| 5,624,360 | A * | 4/1997 | Wilkins | 482/129 |
| 5,807,214 | A * | 9/1998 | Riazi | 482/129 |
| 6,322,483 | B1 * | 11/2001 | Rotella | 482/129 |

* cited by examiner

*Primary Examiner*—Jack W. Lavinder
(74) *Attorney, Agent, or Firm*—Loyd W. Bonneville

(57) ABSTRACT

A pair of cam-buckles properly disposed in a back-to-back manner may be slid along an anchoring strap passed through it and yet reliably kept in place to accommodate loads depending from it regardless of the direction the load is tethered from without danger of slippage along the strap. While this arrangement may be used in a general way for various tasks, it has particularly beneficial application for tethered physical exercise activities. With it, the anchoring strap may be vertically secured around a door and the paired buckles may be moved to any point-high or low-upon the strap, thereby providing variation in tethering direction.

15 Claims, 4 Drawing Sheets

STRAP INTERCONNECTION ADJUSTING ASSEMBLY

BACKGROUND OF THE INVENTION

1. Field of the Invention

Exercise equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term door-mounting loop securing means (104) might be used in one instance but in another, if meaning is otherwise clear from context, expression might be shortened to loop securing means (104) or merely means (104). Any of those forms is intended to convey the same meaning.

The term attach or fasten or any of their forms when so used means that the juncture is of a more or less permanent nature, such as might be accomplished by nails, screws, welds or adhesives. Thus, it is stated herein that the object strap (22) connection to a cam-buckle (21) is one of attachment, for which purpose an attachment sector (33)—or more specifically, a sewn sector (331)—is employed. A connection in which one object is easily removed from another is described by the word emplace, as where it is stated herein that the buffering sheath (24) is emplaced to to enwrap certain portions of the cam-buckles (21). A connection in which two objects, although not attached, could be separated only with considerable difficulty is referred to herein as one of rigid emplacement. The impingement of a buckle's cammed sector (217) against an anchoring strap (1) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the portion of the door enwrapment strap (100) between the ends (101, 102) comprises its mid-length (103), meaning that the latter (103) is in fact the former. The term comprise may also be characterized by what might be considered one-way equivalency, as when it is stated herein that the door enwrapping strap (100) comprises the anchoring strap (1) of the assembly, meaning that in the given instance, the enwrapping strap (100) is itself (100) the anchoring strap (1). This use of the word has a generic sense to it. That is, a door enwrapping strap (100) will always be an anchoring strap (1) but an anchoring strap (1) may be a door enwrapping strap (100) in one case but something else in another. However, the word comprise may also be used to describe a feature which is part of the structure or composition of a given object. Thus, a given embodiment of the inventive assembly is said to preferably comprise, among other things, an intermediate linkage ring (23) as a component thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the object—the adjusting assembly (2), the anchoring strap itself (1) or the components of either (1, 2)—in the manner they (1, 2) would ordinarily be observed if positioned for use. This convention has been adopted as a matter of convenience in discussing orientation and as shown in the drawings, the adjusting assembly (2) regarded as being brought to a point either higher or lower on the anchoring strap (1), itself (1) mounted, where used for exercise, vertically upon the door. The use of the terms in this manner must, of course, be interpreted so as to be equally understood regardless of what attitude the assembly is positioned—such as, for example, if the more generically described assembly—one applied to uses possibly outside of the domain of athletics—were anchored other than vertically.

Certain words have been coined herein to simplify discussion. In some cases, a verb is converted to a noun or adjective and, perhaps, vice-versa. For example, enreeve or derivations thereof such as enreevement stem from the word reeve and are used as a shorthand expression to more conveniently describe an arrangement in which an elongated object is inserted through a given opening. The same is true of enwrapment, deriving from the word enwrap, in which one object is circumscribed within a covering enclosure. The term strap intersection or strap intersection site identifies the meeting place of the end of one strap with some portion of another, such as might be formed, for example, if a cam-buckle (21) were disposed at the juncture. The term slide-braked, ante, refers to the inability of a cam-buckle (21) to be moved, or slid, in a particular direction along a strap. The terms attachment sector and sewn sector (331) identify the site a given attachment is made, the latter referring specifically to a stitched connection upon a strap or straps. The term cammed merely derives from cam and describes a given assembly's configuration. The meanings of such terms are generally explained ante.

The term cam-buckle (21) is used herein to describe a familiar gripping member relatively new but now committed to prior art. It (21) comprises a free-sliding face (211), a thumb lever face (212), an impinging end (213) and a tethering end (214). The impinging end (213) is that which grips the portion of an anchoring strap (1) extended through an opening therein (213). Upon manipulating a thumb lever (218), a cammed member is brought to bear at a cammed sector (217). When the strap (1) is tugged against the camming action its (1) movement is prevented and the assembly is said herein to be slide-braked. A sufficiently vigorous tug in the opposite direction, however, tends to release the cam's grip allowing the strap (1) to slide through the buckle (21). In the former case, the tug causes the strap (1) to engage the buckle's (21) cammed sector (217), ante; the more one tugs, the stronger the grip. In the latter, it (1) becomes disengaged from that sector (217) so that persistent tugging actually weakens the grip. Even with the presence of a knurled finish (215) to enhance the jaws' grip, the slide-braking phenomena remains uni-directional—or, one-way.

In an embodiment in which the buckle (21) comprises a biased spring against the force of which the thumb lever (218) is depressed or pinched down to release the cammed grip, the following observations are appropriate concerning the anchoring strap's (1) movement relative to the buckle (21): The direction of tugging upon the strap (1) which results in slide-braking is from the thumb lever face (212) toward the free-sliding face (211) and that which allows strap (1) to slide through the buckle (21) is the opposite. The phenomena demonstrates the properties of a first degree lever with the force applied to the lever (218) at one end, the load at the other and a lever axle (216) for the fulcrum in between.

In models in which no biased spring is present, however, the camming agent, often disposed integrally upon perimeter of the axle (216), is forced directly against the strap (1) by the thumb lever's (218) rotational manipulation. Although leverage does not play a dominant role in this jamming action, that which is present may be considered to derive from the short distance between the gripping portion of the cammed structure and the center of the lever axle (216), now the fulcrum, in second degree lever fashion.

In seat belts and certain other cammed arrangements, the one-way slippage feature actually facilitates the strap's (1) tightening. Although useful in certain important respects, one can see that this feature provides serious shortcomings where an assembly is dedicated to a different purpose and a reliable strap intersection site is desired.

As indicated supra, it is the anchoring strap (1), as designated herein, which comprises that extended through and impinged within the cam-buckle (21). There are various ways in which it (1) may be reeved through, however. It (1) may, for example, be inserted end-to-end within the buckle (21) and an attached object strap (22) may be allowed to extend from the buckle's tethering end (214) to connect with objects or assemblies—including exercise devices (500)—tethered from the strap intersection. If, instead, an end of the anchoring strap (1) were substituted for the object strap (22), a loop would be formed into a lasso-like assembly. In any event, upon releasing its (21) grip upon the anchoring strap (1), the buckle (21) may be slid in either direction along the strap (1).

Strung through the spring-biased cam buckle (21) in the first manner, as its designating terminology suggests, both ends of the anchoring strap (1) securely fix it (1) in place—that is, indeed anchor it (1)—to a given site. Once so anchored, the cam-buckle (21) is easily repositioned in either direction along the strap (1) merely by manipulating its thumb lever (218).

It would seem that a cam-buckle (21) could benefit a door-enwrapping exercise assembly because it would provide the capability of quickly changing the exercise tethering point (200) inherently comprised by such an assembly. It would only remain to overcome the one-way shortcomings discussed supra.

One very early instance of cam-like impinging action upon an anchoring strap (1) was U.S. Pat. No. 631,486 issued to Fischer in which a certain tilted disposition of the buckle (21) relative to the strap (1)—a horse rein in that instance—permitted elliptical transverse members to slide along it (1). Even earlier, U.S. Pat. No. 307,345 issued to Smith had featured a cam-buckle (21) in which clamping teeth were cammed without benefit of a biased spring to grip an anchoring strap (1) in a pair of suspenders. A few years later, U.S. Pat. No. 1,139,036 issued to Humphrey applied impingement action, if not precisely camming action, to secure a trouser belt buckle. The slide-braking effect was provided by urging a moving member along an opening into an increasingly narrowed sector thereof.

U.S. Pat. No. 2,442,266 issued to Davis; U.S. Pat. No. 3,678,542 issued to Prete, Jr.; and U.S. Pat. No. 3,020,612 issued to Meeker all involved spring-biased camming action wherein a cammed sector (217) was integrally disposed directly upon the buckle's lever axle (216). In all three, the thumb lever (218) was manipulated to act against the bias of the spring. The second of them was configured to require depressing the thumb lever (218) to disengage the strap (1) from the cam, the other two requiring that the lever (218) be raised for such purpose. In the Davis patent, the anchoring strap (1) was the only one employed, one of its (1) ends looped around for insertion through openings at the buckle's tethering end (214) for service as an object strap (22), ante. In the Prete, Jr. patent, both ends of the anchoring strap were strung to extend in the same direction. As it happens, however, the particular routing of the strap (1) is not a matter of great concern. It is, rather, the character of the cam-buckle itself (21) which is the major subject of focus.

Ultimately, an interesting but less pertinent slide-braking seat buckle was provided in U.S. Pat. No. 3,165,805 issued to Lower to operate without reliance upon camming action at all but, rather, upon the interpositioning of a mechanical obstruction. Moreover, certain design patents accumulated along the way and even afterward, including U.S. Pat. Nos. Des. 171,045 issued to Noe; Des. 188,897 issued to Prete, Jr.; and Des. 274,861 issued to Lindblad. In these, all presumably incorporating spring-biased members, camming operation is somewhat vague but strongly inferred.

As suggested, supra, it would be beneficial if the otherwise convenient cam-buckle (21) could be incorporated within an exercise or other assembly to provide a dependable tethering point (200)-one which does not slip out of place when tugging efforts are applied in the non-slide-braking direction. For exercise purposes, for example, an assembly could then be mounted upon a door's face (601) with the anchoring strap (1) run vertically around it and secured on its reverse side (602). Changing the location of the tethering point (200) from high to low or vice-versa could be accomplished with a simple lever (218) manipulation and reliable slide-braking could be counted upon to occur regardless of the tethering direction—that is, whether downwards or upwards. Considering the uni-directional characteristics of the cam-buckle (21), that might seem an impossible objective. How might one employ the common cam-buckle (21) with this inherent shortcoming to provide reliable bi-directional braking capability? Might not one convert this negative or disadvantageous property into a positive or beneficial one?

The simple cam-buckle (21) has given us much in the way of mechanical convenience in a multitude of modern conveniences and thereby filled substantial needs and objectives. Yet, those pointed out supra thus far remain only partly addressed in the prior art. That just immediately addressed, has not been met at all.

SUMMARY OF THE INVENTION

The invention, in general, is a strap interconnection adjustment assembly which permits the intersection between an anchoring strap (1) and a second strap connected to it (1) to be easily moved from one point to another along the anchoring strap's mid-length (103) and to remain reliably fixed in place there (103) until moved again. It overcomes the difficulty presented by the fact that strap intersections traditionally formed, employing a cam-buckle (21) for the purpose, are only uni-directionally reliable because of their one-way slide-braking feature. In a more specific way, the invention has particularly useful application to exercise equipment which can be securely tethered from a mounting place upon a door.

Two cam-buckles (21) are placed together in nose-to-nose fashion with their free-sliding faces (211) in abutment with one another (211). The anchoring strap (1) is inserted straightly through the openings at the impinging ends (213) of both (21) and the object strap (22) is inserted straightly through the thumb lever openings (219) of both (21).

In specific application to exercise equipment in which the strap juncture adjusting assembly (2) is mounted upon a door's face (601), a door enwrapping strap (100) becomes the anchoring strap (1), the exercise tether (221) becomes the object strap (22) and the assembly formed by the conjoined spring-biased buckles (21) together with the exercise tether (221)—the strap juncture adjusting assembly (2)—becomes the exercise tethering point (200).

The door enwrapping strap (100) is anchored on the door's reverse side (602) in general by door-mounting loop securing means (104), preferably more specifically embodied in a miniature hook-and-loop (32) and strap enreevement buckle-frame (31) combination.

The strap interconnection is reliably fixed in place because of the two-way braking action of the back-to-back cam-buckles (21).

In matters of exercise, various equipment including handgrips, lifting bars, devices comprising stretchable elastic cord (552) and apparatus of the like may be adjusted up or down the door and reliably tethered from the adjustment assembly. In a more general sense away from the gym, any objects or assemblies made to depend from the anchoring strap (1) may be just as reliably employed.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

FIGS. 3 and 4, showing the door's face (601), demonstrate placement of the tethering position adjusting assembly at upper and lower sites, thereby permitting operational control of the locus of the tethering point (200)-higher or lower, respectively. FIG. 5 illustrates the door's reverse side (602) with the door mounting securing means (104) shown symbolically.

DESCRIPTION OF THE PREFERRED EMBODIMENT

Figure 1:
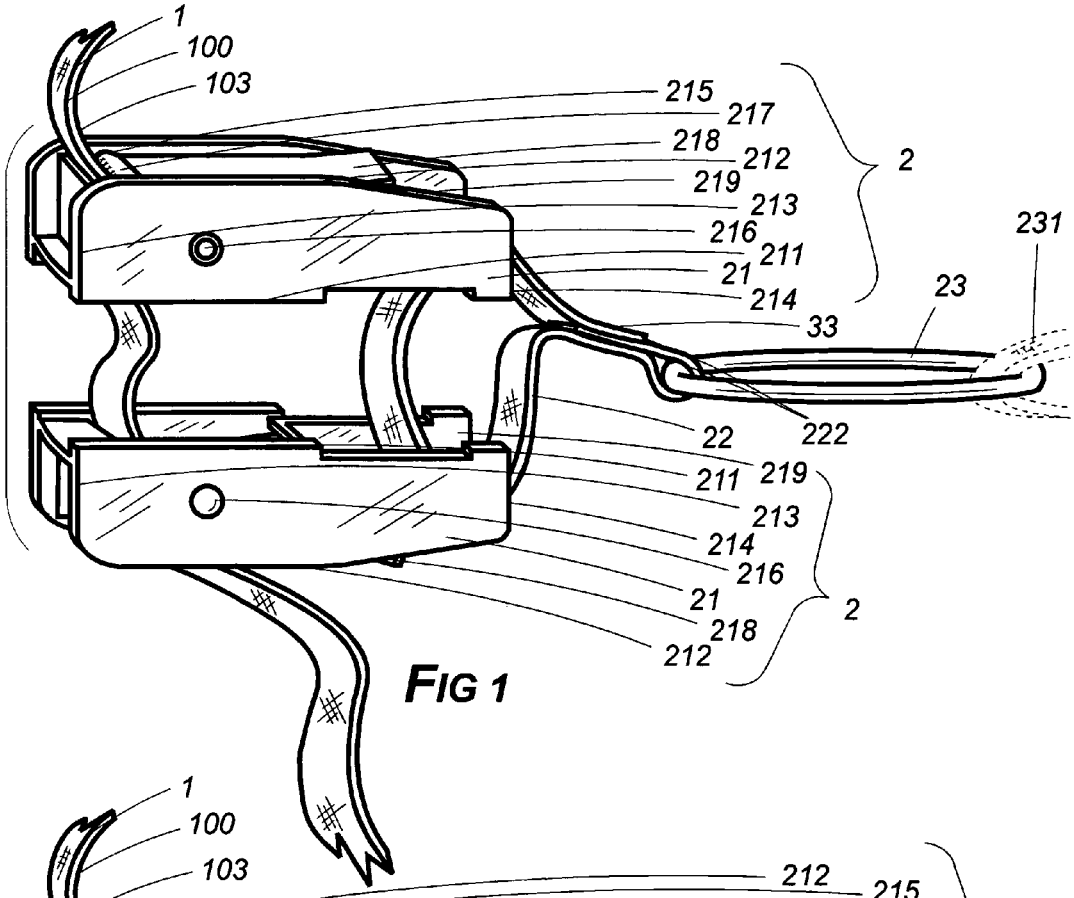
FIGS. 1 and 2 represent in perspective an embodiment of the invention, showing, for a better understanding thereof, the cam-buckles (21) comprised by the tethering position adjusting assembly both separated from and abutted to one another (21), respectively. An intermeidate linkage ring (23) is included in the version shown in these two drawings.
Figure 2:
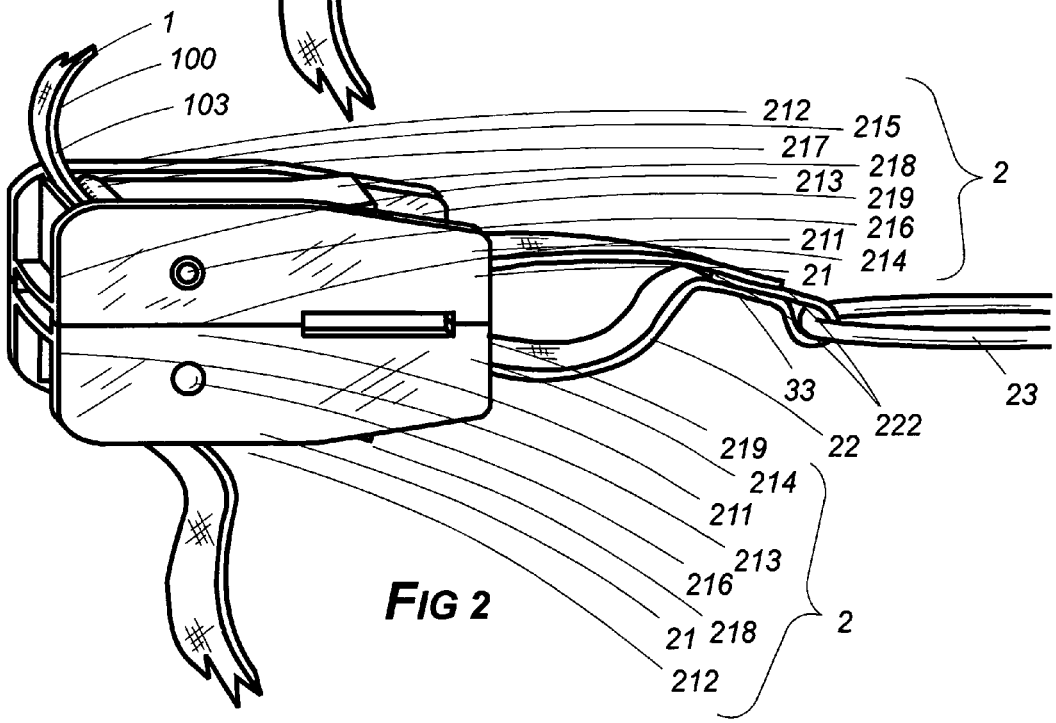
Figure 3:
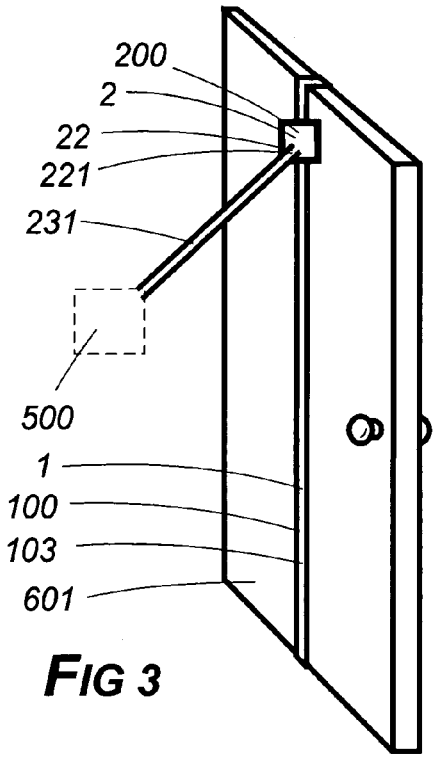
FIGS. 3–5 comprise perspective views of the inventive assembly installed upon a door in its usual manner. Certain features are shown symbolically to allow focus upon their disposition.
Figure 4:
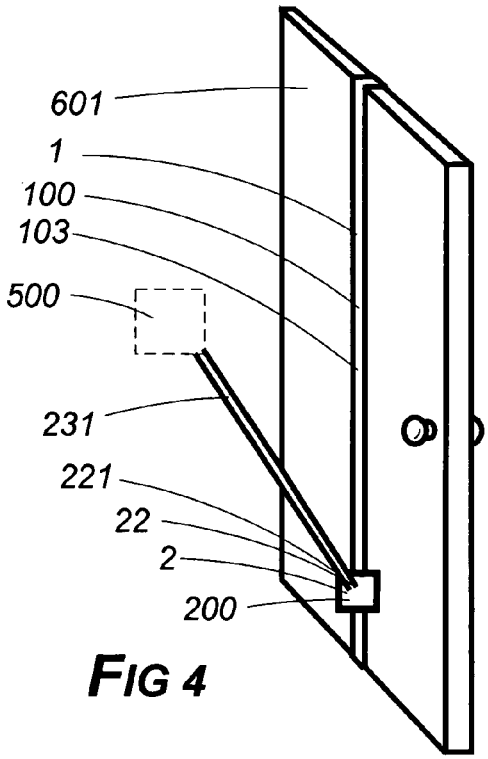
Figure 5:
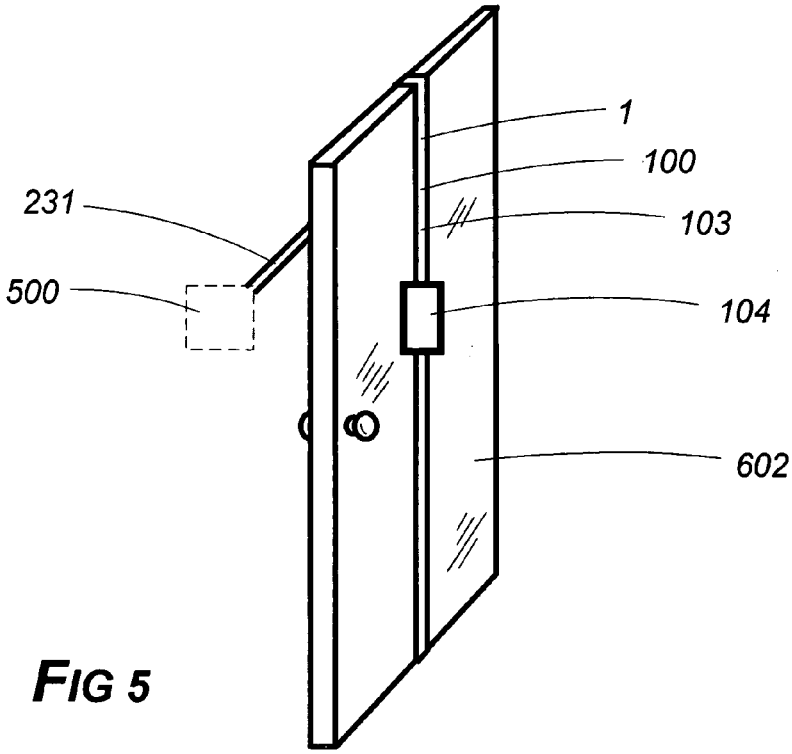
Figure 6:
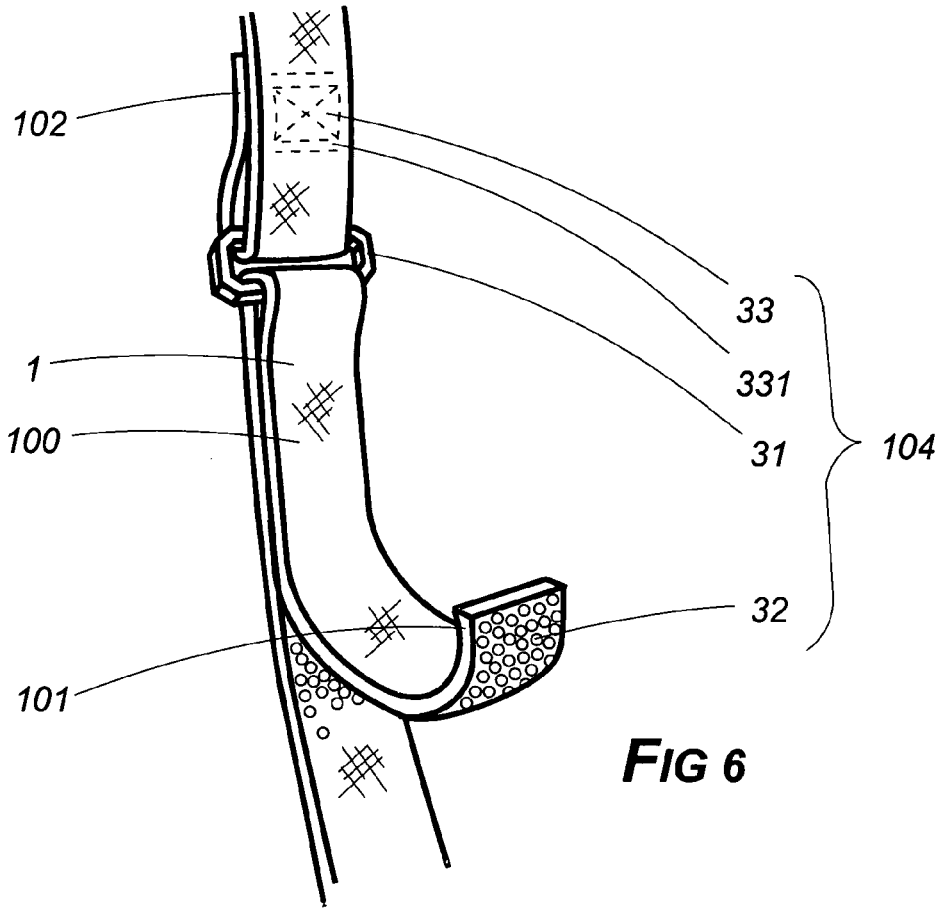
FIG. 6 depicts the door mounting securing means (104) in which the enwrapping strap is configured with self retentional connection means comprising miniature hook and loop sectors (32).
Figure 7:
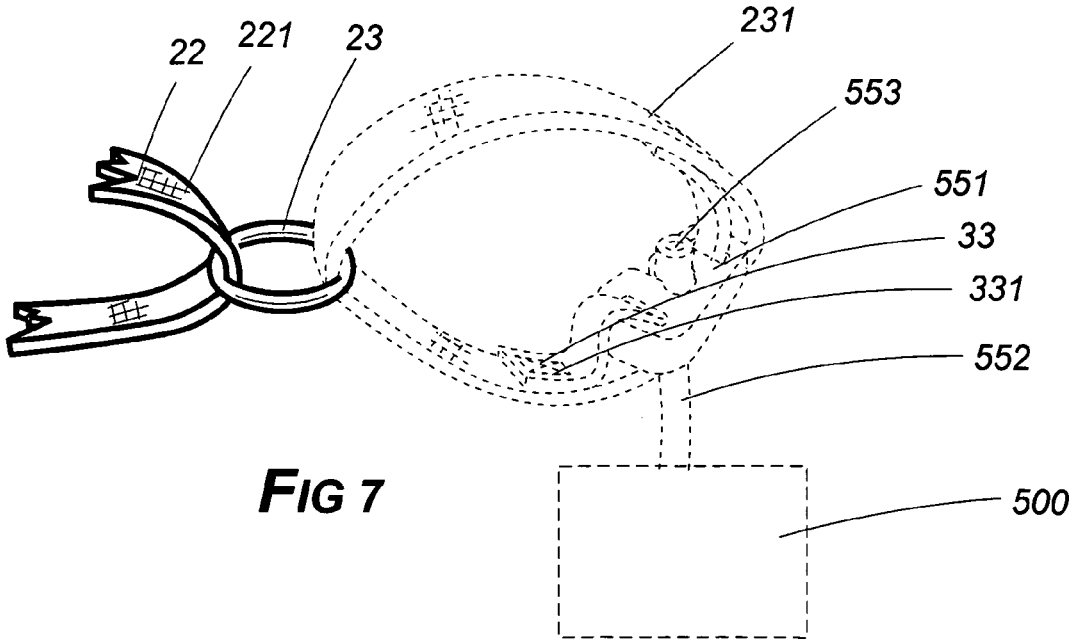
FIG. 7 illustrates a particular type of various exercise device linkage (231), in this case including a stretchable elastic exercise cord (552) and its connection block (551). The exercise device to which the linkage (551) extends is shown symbolically.

The subject of this application comprises a strap interconnection adjusting assembly featuring a particular mechanism permitting quick and dependable fixed relocation of the junction between an object strap (22), supra, including anything depending from it (22), and an anchoring strap (1), supra. The assembly may be dedicated to any end in which such a combination is present or desired but is of particular interest and benefit where exercise devices are concerned.

The mechanism itself, herein designated a strap juncture adjusting assembly (2), is a combination of two—that is, a pair—of a well known prior art device—or alternatively, the method of so employing them. The two may be employed either in its application to physical exercise or in its own right for any imaginable use either in or outside of the physical exercise realm.

The strap juncture adjusting assembly (2) is mounted upon the anchoring strap (1). From this assembly (2) extends what is herein designated an object strap (22), which connects to any object or assembly sought to be employed in an anchored manner from the anchoring strap (1). The object or assembly so connected is, therefore, said herein to depend from the anchoring strap (1)—or more precisely, to depend from it (1) by strapped connection. The intersection point of the two straps (1, 22) may be changed—that is, relocated—by sliding the strap juncture adjusting assembly (2) along the anchoring strap (1).

A pair of cam-buckles (21) comprise the juncture adjusting assembly (2). Each (21) is oppositely disposed in with reference to the other (21), the free-sliding face (211) of each (21) abutting that (211) of the other (21) so that their thumb lever faces (212) are oppositely situated outwardly. The impinging end (213) and the tethering end (214) of each (21) are oriented in the same direction as those (213, 214) of the other (21)—that is, the two (21) are situated nose-to-nose, as it were.

To mount the adjusting assembly (2) upon the anchoring strap (1), an end of the strap (1) is reeved through both conjoined or abutted buckles (21). To create an opening for the strap (1) end's passage, the thumb lever (218) of each buckle (21)—whether of the spring biased variety or not—must be depressed to open its (21) impinging jaws.

Recognizing a cam-buckle's (21) one-directional slide-braking character, supra, the opposing disposition of the two of them (21) in abutment dependably assures the immobility required for a fixed strap (1, 22) intersection. Upon depressing both levers (218), the two buckles (21) can be slid in either direction. If only one lever (218) is depressed, the two (21) are permitted to slide in only one direction, depending upon which (218) was depressed. If neither lever is depressed, the impingement feature of both buckles (21) is engaged and neither (21) will move at all, thereby providing a connection of rigid emplacement.

Since the tethering end (214) of each buckle (21), whether or not spring-biased, is oriented in the same direction as that (214) of the other (21), an object strap (22) is conveniently reeved through their thumb lever openings (219) so that the assembly (2) can be connected to the particular object or assembly made to depend from the anchoring strap (1).

Conceivably, the object strap (22) may be open-ended such that its ends (222) connect directly to the object or assembly to be manipulated or operated. Experience has shown, however, that for a desired connection, this strap (22) should be formed into a closed loop, typically as a member of linkage strapping (231) connecting to the object or assembly being employed. To that end, it (22) is preferably reeved or otherwise connected to some other part of the linkage (231) and afterwards self-attached—that is, attached back upon itself (22)—in some manner at an attachment sector (33). This is preferably accomplished by means of stitching wherein a sewn sector (331) comprises the attachment sector (33), although rivets or other attachment means may just as well be satisfactorily employed.

Although not an absolute necessity, the assembly preferably comprises an intermediate linkage ring (23) to which the object strap (22) connects. Linkage strapping (231) may then be extended from the ring (23) to the object or assembly employed. Strap attachments throughout the linkage (231) may be in the manner discussed just supra for the object strap (22).

Figure 8:
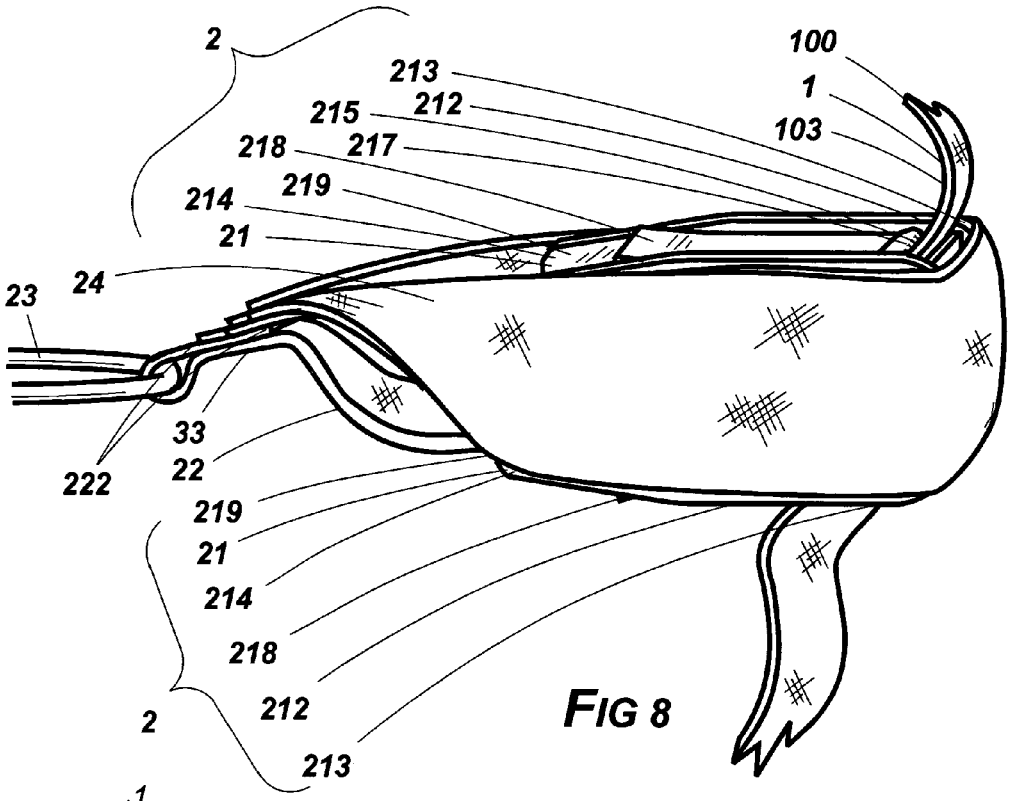
FIG. 8 features an assembly comprising a buffering sheath (24) for protection of the door's face (601) with a portion thereof (24) emplaced over the thumb lever faces (212) and the impinging ends (213) of the paired buckles (21).
Figure 9:
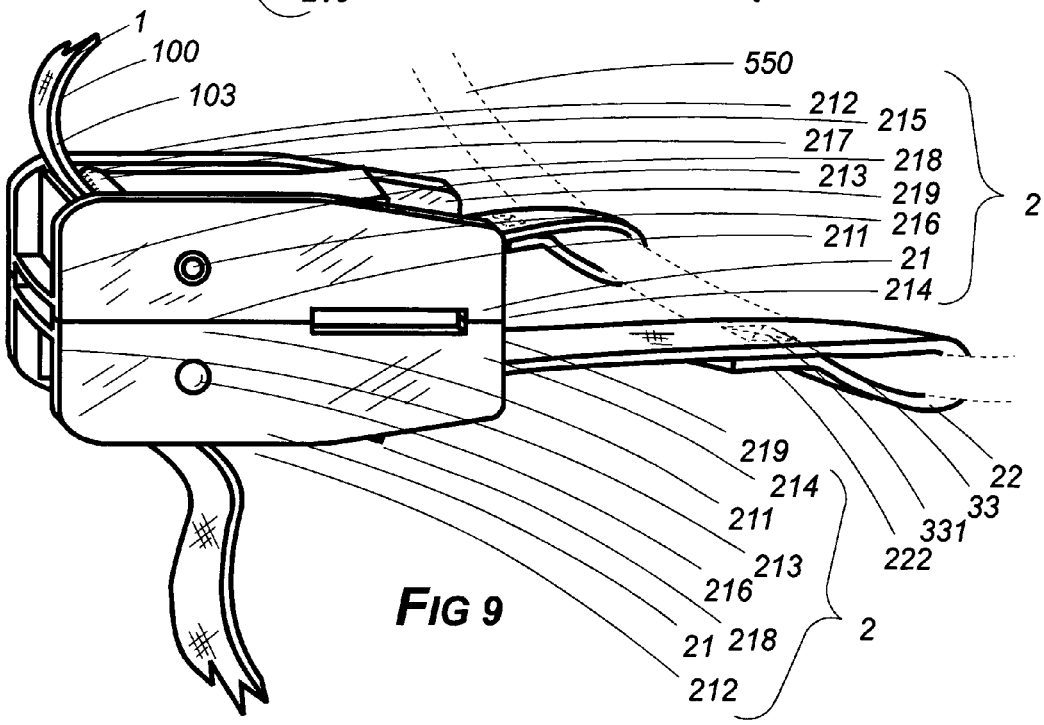
In FIG. 9, the object strap (22) is open-ended, illustrating means of connection to any sort of exercise equipment (500).

In any application of the invention in which there is concern for scratching or surface damage in the vicinity of the abutted buckles (21), a buffering sheath (24) may be included as part of the juncture adjusting assembly's (2) structure. Such a strap (24) is attached to the object strap (22) and emplaced to enwrap all or a portion of the cam-buckles (21) to avert abrasive damage to any surface it (21) is disposed near. Attachment is accomplished at both ends—that is, in a loop, as stated herein—at an attachment sector (33), preferably by the above-described means. An embodiment of such a strap (24) is illustrated in FIG. 8 to cover the entirety of the cam-buckle's impinging end (213), serving as an intermediary between the buckle (21) and the surface in question.

What has thus far been described has been observed to work particularly well with exercise assemblies-handgrips, lifting bars and the like. For such application, it is appropriate to move from the generic to the more specific, as it were.

To address the anchoring inconsistency and tethering point (200) relocation difficulties discussed supra, the strap juncture adjusting assembly (2) may be used to considerable advantage in conjunction with a door wrap-around exercise assembly. A door enwrapping strap (100) comprises the anchoring strap (1) of the assembly. It (100) is disposed to encircle or enwrap a door. Preferably, it is disposed vertically thereon so that variations in exercise tethering point (200) height may be set, ante. Albeit feasible, variations in settings to the right or left provided by a horizontally mounted strap (100) are not of particularly great import.

The door enwrapping strap (100) of considerable length13 more than twice the height of the door—is, therefore preferably employed. Like any other, of course, the strap (100) comprises two ends—a first (101) and a second (102) thereof. The portion of the strap (100) between the ends (101, 102) is said herein to comprise its mid-length (103). The strap (100) is caused to completely encircle the door in vertical orientation, with its ends (101, 102) brought together for connection on the door's reverse side (602). The connection apparatus is herein designated door-mount loop securing means (104).

The strap's first end (101) is configured in a manner which permits it to connect securely with the strap's second end (102), preferably on the door's reverse side (602). Numerous connection possibilities are extant in the art. For example, the familiar belt buckle type arrangement would work as well as any other. Combinations of snap-together fittings are also feasible, so long as means to adjust the strap's (100) length are also present. Preferably, for the sake of convenience, a miniature hook and loop sector (32) is included for such purpose and is said herein to be disposed at the strap's first end (101). As an additional preference, the strap's second end (102) comprises a strap enreevement buckle-frame (31) connected to the strap (100) at an attachment sector (33), preferably a sewn sector (331). This feature (31) permits the enwrapping strap (100) to be reeved through it (31) and then doubled back upon itself (100) so that the miniature hook-and-loop sector (32) is engaged for acceptable connection.

As in the case of the generic model, the exercise assembly also preferably comprises an intermediate linkage ring (23) to which the object strap (22) connects. Linkage strapping (231) may then be extended from the ring (23) to the object of various exercise devices (500). One of the more superior linkage components is a stretchable cord connection block (551), the subject of an invention addressed elsewhere, through strap tunnels of which strapping is run, doubled back upon itself and attached as in the other strap connections supra.

In door exercise application, it becomes more important to include the buffering sheath (24) discussed supra, the door's face (601) comprising the surface of concern.

In many combinations of well known objects or ingredients, the possibility of novelty in method or process exists. Such is the case here. The object of the method is to provide means of unimpeded repositioning of tethered objects or assemblies along an object strap (100) such that the attained position comprises a connection of rigid emplacement. The steps the method comprises to accomplish that end are: First, dispose a pair of cam-buckles (21) in conjunction such that the free-sliding face (211) of each (21) abuts that (211) of the other (21) and the impinging end (213) and tethering end (214) of each (21) are oriented in the same direction as those (213, 214) of the other (21) such that their respective thumb lever faces (212) are oppositely disposed; second, pass a tethering strap (22) through the thumb lever openings (219) of both abutted cam-buckles (21); and third, link its ends (222) to various devices, including those for exercise (500).

What is claimed is:

1. A strap interconnection adjusting assembly comprising:

an anchoring strap; and a strap juncture adjusting assembly;

the juncture adjusting assembly comprising in turn:

a pair of cam-buckles; and an object strap;

wherein each cam buckle comprises a free-sliding face, an impinging end, a tethering end and a thumb lever and is disposed in conjunction with the other of the pair such that the free-sliding face of each abuts that of the other and the impinging end and tethering end of each are oriented in the same direction as those of the other so that their respective thumb lever faces are oppositely disposed;

the object strap disposed to pass through the thumb lever openings of both abutted cam-buckles;

wherein the anchoring strap is reeved through the impinging ends of the abutting cam-buckles;

the assembly thereby providing means of unimpeded repositioning upon the anchoring strap of the strap juncture adjusting assembly including the object strap and anything extending from it merely by depressing the thumb levers of the buckles and sliding the adjusting assembly in either direction along the anchoring strap's mid-length such that upon release of the thumb levers, the attained position comprises a connection of rigid emplacement.

2. The strap interconnection adjusting assembly according to claim 1 wherein the object strap is open-ended for connection of each end thereof to various assemblies.

3. The strap interconnection adjusting assembly according to claim 1 wherein a door enwrapping strap comprises the anchoring strap, disposed to enwrap a door and comprising door-mounting loop securing means;

wherein the strap juncture adjusting assembly provides an exercise tethering point and the object strap, an exercise tether, the strap's ends providing linkage to various exercise devices.

4. The strap interconnection adjusting assembly according to claim 3 wherein the disposition of the anchoring strap's door enwrapment is vertical;

wherein the strap juncture adjusting assembly is adjusted to set the exercise tethering point at any height.

5. The strap interconnection adjusting assembly according to claim 3 wherein the door-mounting loop securing means comprises a miniature hook-and-loop sector disposed upon a first end of the anchoring strap and a strap enreevement buckle-frame attached to a second end thereof.

6. The strap interconnection adjusting assembly according to claim 5 wherein the strap enreevement buckle-frame's means of attachment to the anchoring strap comprises an attachment sector wherein the strap's second end is reeved, doubled back upon itself and attached in place.

7. The strap interconnection adjusting assembly according to claim 6 wherein a sewn sector comprises the attachment sector and the attachment of the second strap's ends comprises stitch-work.

8. The strap interconnection adjusting assembly according to claim 3 wherein the object strap's linkage to various exercise devices is provided by attaching the object strap's ends and one or more exercise devices to an intermediate linkage ring.

9. The strap interconnection adjusting assembly according to claim 8 wherein the intermediate linkage ring's means attachment comprises one or more attachment sectors wherein an end of each strap is reeved through the ring, doubled back upon itself and attached in place.

10. The strap interconnection adjusting assembly according to claim 3 wherein the tethering strap's linkage to various exercise devices is provided by attaching its strap ends to a stretchable elastic cord connection block comprising strap tunnels.

11. The strap interconnection adjusting assembly according to claim 10 wherein the means attachment of the tethering strap and the cord connection block comprises one or more attachment sectors wherein an end of each strap is reeved through a respective strap tunnel of the connection block, doubled back upon itself and attached in place.

12. The strap interconnection adjusting assembly according to claim 3 further comprising a buffering sheath attached in a loop to the tethering strap and disposed to enwrap all or a portion of the abutted cam-buckles;

whereby abrasive damage to the door is averted.

13. A method of providing means of unimpeded repositioning of objects or assemblies depending by strapped connection from an anchoring strap such that the attained position comprises a connection of rigid emplacement, comprising the following steps:

first, dispose a pair of cam-buckles upon the anchoring strap in conjunction such that the free-sliding face of each abuts that of the other and the impinging end and tethering end of each are oriented in the same direction as those of the other so that their respective thumb lever faces are oppositely disposed;

second, pass an object strap through the thumb lever openings of both abutted cam-buckles; and third, link that strap to any object or device for which dependency from the anchoring strap is sought.

14. The strap interconnection adjusting assembly according to claim 1 wherein the each cam-buckle's thumb lever is spring biased.

15. The strap interconnection adjusting assembly according to claim 12 wherein the means attachment of the buffering sheath to the tethering strap comprises one or more attachment sectors wherein an end of each strap is doubled back upon itself and attached in place.

* * * * *